United States Patent [19]

Dunse

[11] Patent Number: 5,018,745

[45] Date of Patent: May 28, 1991

[54] BLIND RINGER TOSSING GAME

[76] Inventor: Walter D. Dunse, 410 S. Washington, Jerseyville, Ill. 62052

[21] Appl. No.: 591,254

[22] Filed: Oct. 1, 1990

[51] Int. Cl.[5] ..... A63B 67/06

[52] U.S. Cl. ..... 273/338; 273/400

[58] Field of Search ..... 273/336, 337, 338, 339, 273/398, 399, 400, 401, 402

[56] References Cited

U.S. PATENT DOCUMENTS

| | | | |
|---|---|---|---|
| 915,450 | 3/1909 | Levey | 273/336 |
| 922,717 | 5/1909 | Parker | 273/401 |
| 1,098,872 | 6/1914 | Akerberg | 273/336 |
| 1,212,794 | 1/1917 | Mark | 273/337 |
| 2,050,914 | 8/1936 | Anderson | 273/401 |
| 2,432,824 | 12/1947 | Shetler | 273/336 X |
| 2,666,642 | 1/1954 | Ward | 273/336 |
| 3,628,793 | 12/1971 | Mudloff | 273/402 |
| 3,837,650 | 9/1974 | Haney | 273/402 |
| 4,169,596 | 10/1079 | Chinenson | 273/401 |
| 4,203,592 | 5/1980 | Quatkemeyer | 273/336 |
| 4,243,229 | 1/1981 | Huser | 273/402 |
| 4,373,734 | 2/1983 | Frank | 273/411 |
| 4,461,484 | 7/1984 | Headrick | 273/400 |
| 4,565,375 | 1/1986 | Dresel | 273/401 |
| 4,717,156 | 1/1988 | Wright | 273/401 |
| 4,877,256 | 10/1989 | Falloon | 273/400 |

*Primary Examiner*—William H. Grieb

*Attorney, Agent, or Firm*—Don W. Weber

[57] ABSTRACT

A target/projectile game is presented which has an essentially square-shaped target and disc-shaped projectiles. The square-shaped target has a flat horizontal board located inside a square-sided box. The flat board is divided into scoring areas and has two adjacent cylindrical bull's-eye targets in the center of the board. Inside each cylinder is a narrow exact bull's-eye peg. The cylinders and pegs rise above the surface of the flat board. Discs are thrown and points are added (or substracted) depending on the accuracy of the throw. A variation of the game is played when a top box-shaped blinder top cover is placed over the lower box and flat board. The blinder cover has an opening through which the discs must be thrown to score points.

6 Claims, 3 Drawing Sheets

BLIND RINGER TOSSING GAME

BACKGROUND OF THE INVENTION

This invention relates to the field of recreation and more particularly to the field of an indoor or outdoor tossing game involving a target and a plurality of disc-shaped projectiles.

There are many tossing games known throughout the U.S., the most popular one being that of horseshoes. However, a number of other tossing games have also been devised and patented. One such tossing game, patented in 1989, involves a pair of target trays which have a number of cylindrical cups of varying heights placed within four perpendicular walls. The game is played by separating the two targets and tossing projectiles (preferably discs) into the target and cups. Points are scored depending upon the target which is hit. This patent, U.S. Pat. No. 4,877,256, is one type of tossing game.

Another type of tossing game apparatus is shown in the 1986 patent issued to Dresel, U.S. Pat. No. 4,565,375. This tossing game involves a game apparatus which has one or more targets into which one or more objects are thrown. The Dresel target has a flat horizontal surface on the target which has a central circular hole cut therein. One of the objects of the game is to throw a flat disc or other projectile into the circular hole and thus to score points. A projectile thrown onto the surface, but not through the hole, would score a varying number of points.

The instant invention is different from the other games known in the art in that it involves a more difficult skill level as well as the use of a covering which partially obscures the viewing range of the contestants. This upper element, which makes the ringers tossed "blind ringers", and other aspects of the invention add a new, unique and exciting dimension to those tossing games already in common use throughout this country.

BRIEF DESCRIPTION OF THE PREFERRED EMBODIMENT

This new invention comprises a singular target which is placed at any suitable location either inside or outside of a building. The open-viewing version of the game involves a flat horizontal board which is divided into a number of scoring areas painted on the top surface thereof. Near the center of the flat horizontal top board are side by side cylindrical bull's-eye targets. The longitudinal axis of each cylinder is perpendicular to the board and the cylindrical target areas rise a distance above the flat horizontal surface of the top board. In the center of each cylindrical bull's-eye is an exact bull's eye peg which is also perpendicular to the horizontal top board. Around the perimeter of the top board are perpendicular sides which retain the discs which are tossed at the target by each player.

Players take turns tossing discs at the target thus accumulating points. Bonus points are accumulated for a disc tossed in the cylindrical bull's-eye (usually 10 points). A greater number of points are awarded for tossing the discs onto the exact bull's-eye pegs (usually 20 points).

A variation of the game includes a top cover for the board which greatly diminishes the contestant's view of the top board, cylinders and pegs. With a much smaller opening, scoring is much more difficult. The top part of the game apparatus is removable so that either version may be played.

It is an object of this invention to provide a tossing game which may be played indoors or outdoors. It is also an object of this invention to provide a tossing game which may be varied so as to obscure a contestant's view of the target and make scoring more difficult. It is a further object of this invention to provide a unique game apparatus which may be transported conveniently for use in many different locations.

Other and further objects of this invention will become apparent upon viewing the following description.

DETAILED DESCRIPTION OF THE PREFERRED EMBODIMENT

Figure 1:
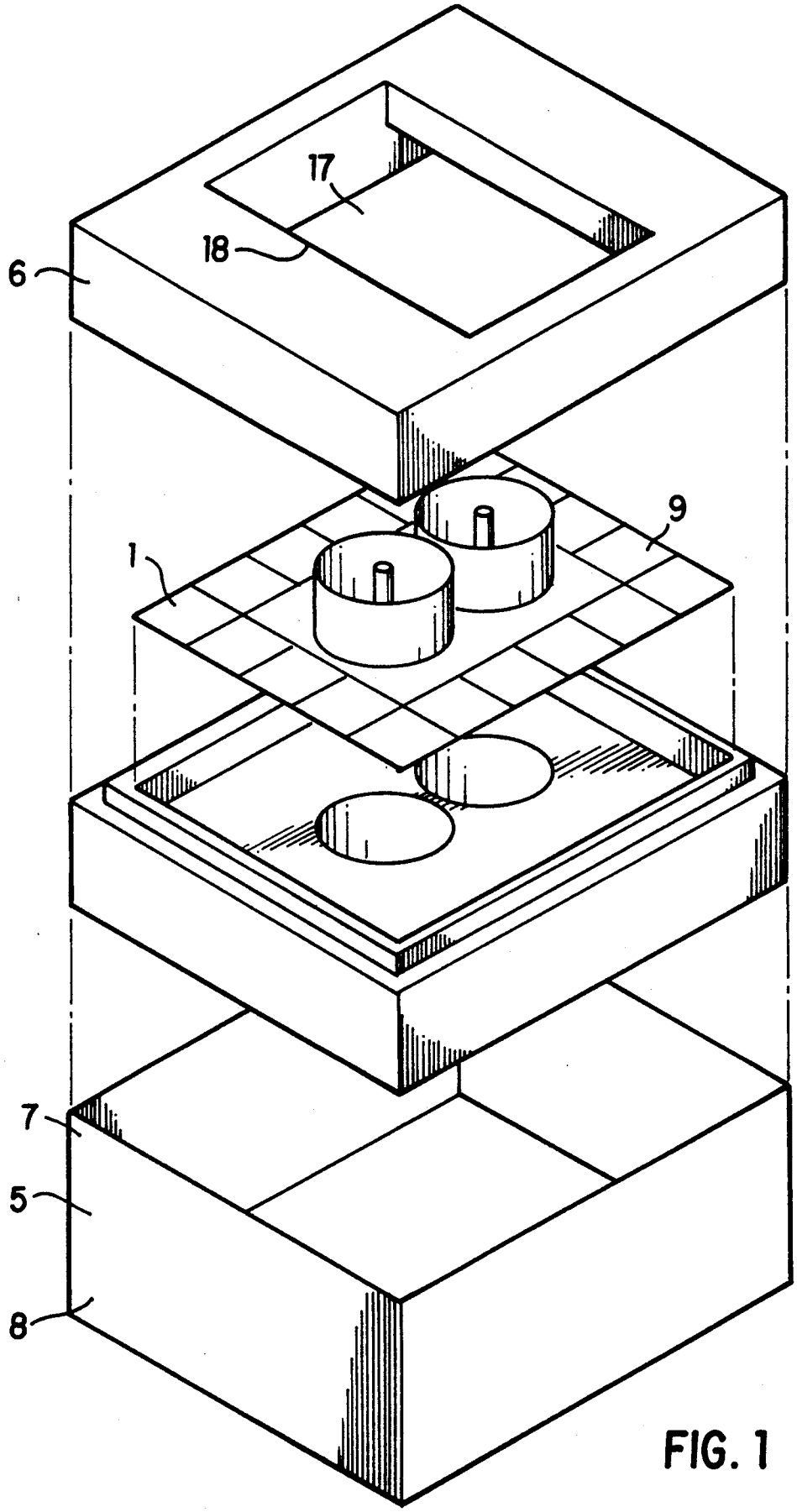
FIG. 1 is an exploded perspective view of the game apparatus.

The game described herein can be played by any number of players. The game apparatus comprises an essentially cubical target divided into halves, having a lower box 5 and an upper blinder 6. A top board 1 is placed approximately midway between the upper part 7 and the bottom base 8 of the lower half of the box. This top board is perpendicular to the sides 2 but parallel to the base 8 of the lower box, and provides a horizontal scoring surface.

Figure 2:
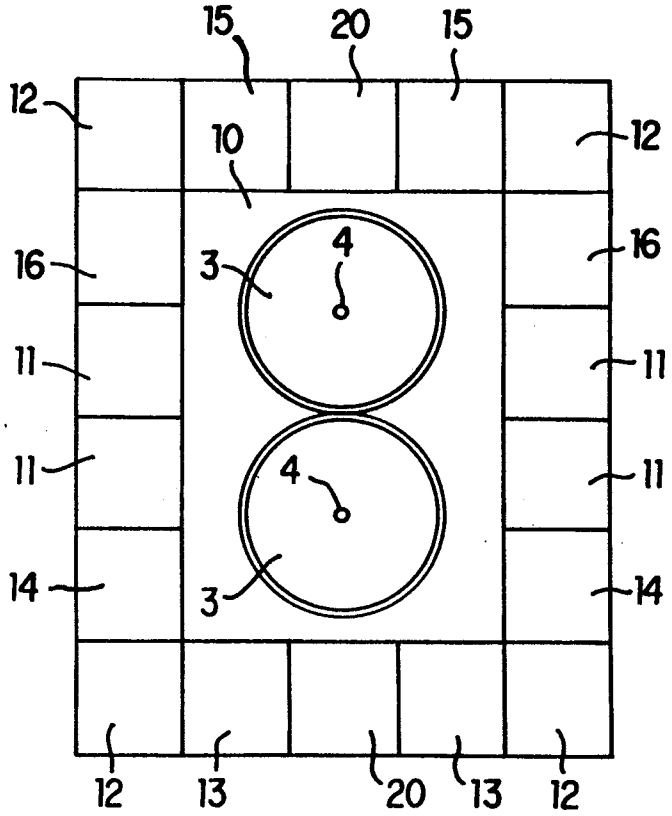
FIG. 2 is a top view of the top board, cylinders, and pegs showing the general layout of the scoring.

The top board 1 is divided into a number of scoring areas 9. These scoring areas indicate the number of points to be added (or subtracted) to a player's score depending upon where the projectile disc lands. Adjacent cylindrical bull's-eyes are located near the center of the top board and protrude above it. An exact bull's eye peg 4 is in the center of each cylindrical bull's-eye and is perpendicular to the board. Typically, the scoring area 10 which surrounds the cylindrical bull's-eyes would score no points. Other scoring areas 11 would add four points to a player's score. Scoring areas 12 would add 1 point to a player's score. Scoring areas 13 and 14 would subtract 3 and 2 points, respectively from a player throwing in the direction of top to bottom in FIG. 2. Scoring areas 15 and 16 would subtract 3 and 2 points from the opposite player's score. Scoring area 20 scores 5 points for a player.

The scoring areas are symmetrical about the central axis of the top board 1. A player may only score in the half of the board furthest away from him. Throwing a disc into the cylindrical bull's eye 3 furthest from the player would score 10 points while throwing a cylindrical disc onto the exact bull's eye peg 4 furthest from the player would score 20 points for the contestant.

Playing the game is simple but requires a certain degree of skill. The game apparatus is placed on the floor or ground and the players each stand approximately 12 feet away from the target. Opposing players stand opposite each other along a line take through the exact pegs. The generally rectangular opening slot 17 has its length 18 perpendicular to the throwing lines of each player. The players are approximately 24 feet apart, each 12 feet from the target. Players alternate throwing their discs, which are preferably color-coded to distinguish opposing players'discs, with each player usually throwing three discs. The discs are then retrieved and the points counted up and awarded to (or subtracted from) the player's score. Each player may only score on the side of the board opposite that player. For example, if a player were tossing his discs from a direction below the board 1 shown in FIG. 2, he could only score on the upper half of the board (and the upper cylinder and peg) shown on the drawing FIG. 2. The game ends when one player or team reaches a total of 50 points.

Figure 5:
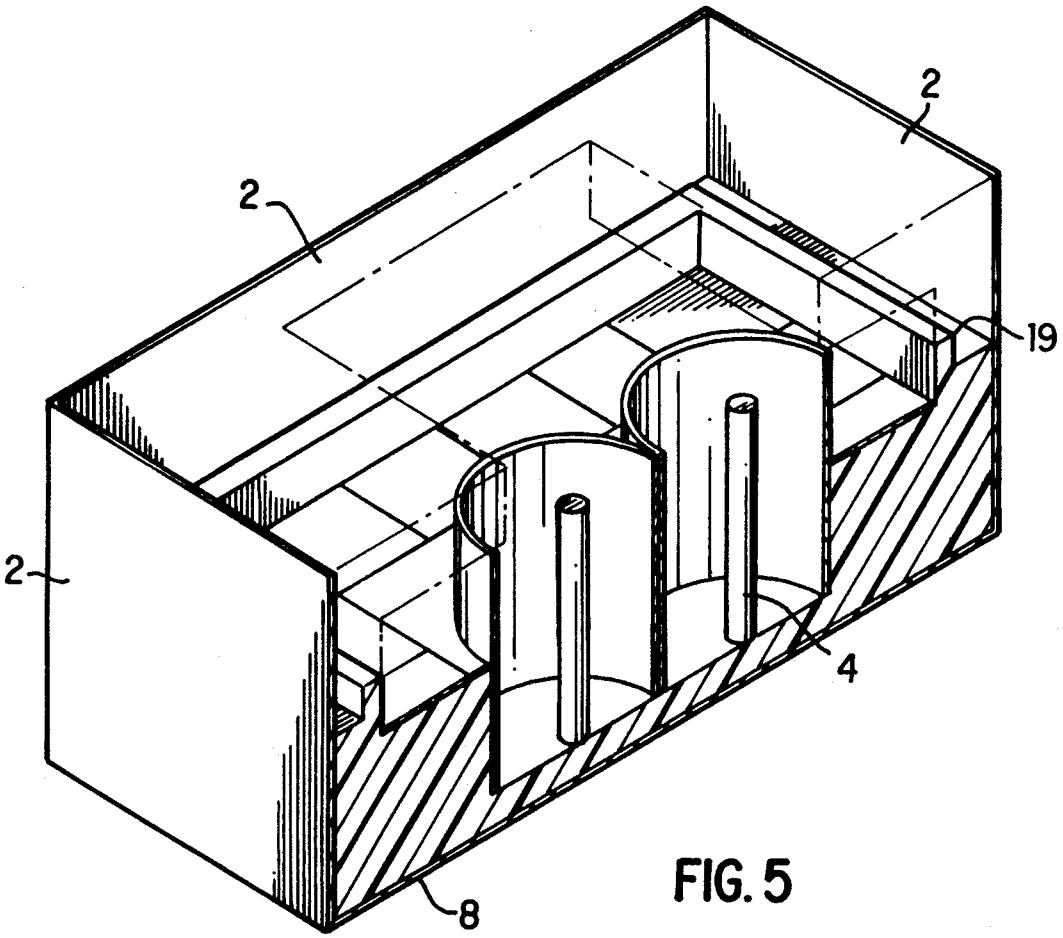
FIG. 5 is a side cut-away perspective view of the apparatus with the blinder removed from the bottom of the game board.
Figure 3:
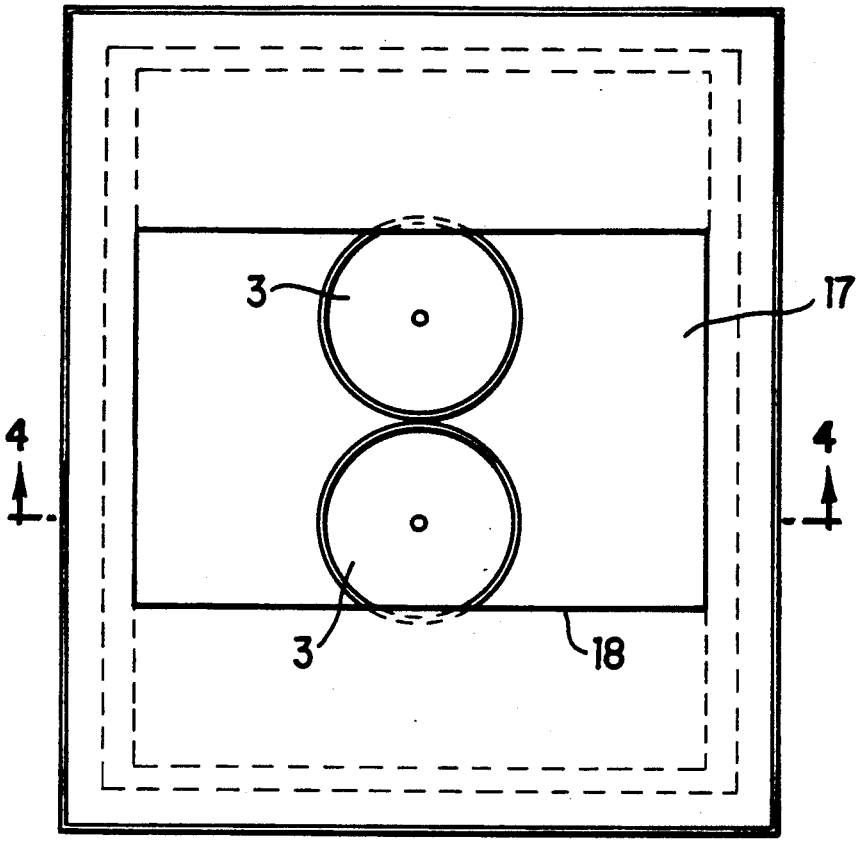
FIG. 3 is a top view of the game apparatus with the blinder attached to the game apparatus.
Figure 4:
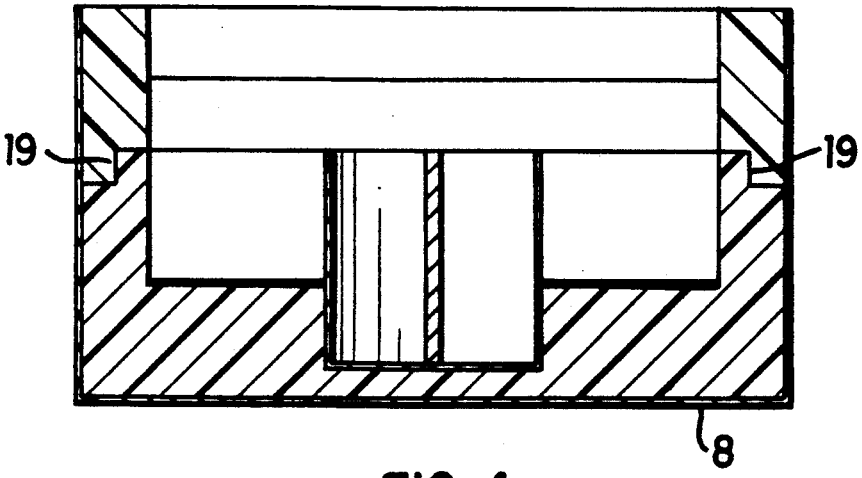
FIG. 4 is a side cut-away view of the game apparatus, taken along lines 4—4.

To make scoring more difficult an upper blinder box 6 may be added to the game apparatus. This upper blinder box 6 is placed over the top of the lower box 5 and top board 1 and secured to the lower box 5 by any suitable means. VELCRO strips, buckles, or the unique tongue and groove 19 as shown on FIGS. 4 and 5 may be used to secure the upper blinder 6 to the lower box 5. The upper blinder 6 has an open target slot 17 cut from the top thereof. Discs are then thrown through this open target slot 17 and scoring is done as previously stated. The addition of the upper blinder box 6 makes scoring more difficult and hence raises the level of skill required to win the game. A "blind ringer" is scored when a player tosses a disc onto his exact bull's-eye peg with the upper blinder box fastened on top of the lower game apparatus.

The projectiles used with this game are, in the preferred embodiment, cylindrical discs made of either wood or plastic. The discs have a central hole in them which is large enough so that a properly thrown disc will fit over the exact bull's-eye peg.

The entire game apparatus may be made of any suitable material such as wood, plastic, or any other type of material. While the values assigned to the bull's-eyes and scoring areas are preferred, it is within the contemplation of this invention to have different values assigned. The preferred goal of the game is to score 50 points. However, any number of points may be utilized as the winning number and still be within the contemplation of this particular invention. The open target slot 17, in the preferred embodiment, is a rectangular slot as shown on FIG. 4. Any type of geometric shape for the slot is within the contemplation of this invention.

Having fully described my new invention, I claim:

1. A portable tossing game for one or more players, comprising:

(a) an essentially cubicle target box having upper and lower halves which are detachably connected to each other;

(b) a horizontal top board located midway between the upper part and the bottom base of said lower half, said top board being divided into a plurality of scoring areas;

(c) said top board having two adjacent cylindrical bull's-eyes located near the center of said board and protruding above it;

(d) an exact bull's eye peg, located in the center of each cylindrical bull's eye; and (e) a plurality of discs having central holes large enough so that they can be thrown around said exact bull's-eye pegs.

2. A portable tossing game for one or more players as in claim wherein the upper half of said target box has an essentially rectangular slot cut from the top surface thereof, whereby said upper half may be detachably connected to said lower half to obscure the view of the players.

3. A portable tossing game for one or more players as in claim 1, wherein said scoring areas are marked to indicate points to be added or subtracted from a player's score.

4. A portable tossing game for one or more players, as in claim 1, wherein said bull's-eye protrusions may be of any geometrical shape.

5. A portable tossing game for one or more players as in claim 1, wherein the slot cut from the top surface of the upper half of said box may be of any geometrical shape.

6. A portable tossing game for one or more players as in claim 1, wherein the plurality of scoring areas are symmetric about a central axis of said top board.

* * * * *